US006015136A

United States Patent [19]

Benudiz

[11] Patent Number: 6,015,136

[45] Date of Patent: Jan. 18, 2000

[54] PORTABLE FASTENER REMOVER APPARATUS

[76] Inventor: Hilel Benudiz, 21931 Annette Ave., Lake Forest, Calif. 92630

[21] Appl. No.: 09/094,791

[22] Filed: Jun. 15, 1998

[51] Int. Cl.[7] ..... B66F 15/00

[52] U.S. Cl. ..... 254/18

[58] Field of Search ..... 254/18, 29 R, 254/30, 31, 10.5

[56] References Cited

U.S. PATENT DOCUMENTS

| | | | |
|---|---|---|---|
| 2,691,505 | 10/1954 | Hursh | 254/18 |
| 2,797,889 | 7/1957 | Talboys . | |
| 2,826,446 | 3/1958 | Hursh . | |
| 3,791,004 | 2/1974 | Crafford et al. . | |
| 3,814,382 | 6/1974 | Castoe | 254/10.5 |
| 4,395,020 | 7/1983 | Spainhour | 254/10.5 |
| 4,646,410 | 3/1987 | Good . | |
| 4,648,166 | 3/1987 | Tilman . | |
| 5,065,984 | 11/1991 | Hake et al. . | |
| 5,159,743 | 11/1992 | Somerville . | |
| 5,337,470 | 8/1994 | Hoffman et al. . | |
| 5,375,313 | 12/1994 | Apodaca et al. . | |
| 5,379,986 | 1/1995 | Perez et al. . | |
| 5,385,060 | 1/1995 | Wang . | |
| 5,694,672 | 12/1997 | Perin . | |

*Primary Examiner*—Robert C. Watson

*Attorney, Agent, or Firm*—Stetina Brunda Garred & Brucker

[57] ABSTRACT

In accordance with the present invention, there is provided a portable fastener removal apparatus for removing an elongate fastener having an axis of radial symmetry from a structure in which the fastener is embedded. The fastener removal apparatus is provided with a housing having an elongate channel which defines a housing axis. The housing is sized and configured to be positionable upon the structure such that the housing axis is coaxially aligned with the axis of radial symmetry. The fastener removal apparatus is further provided with a force transfer member which is movably attached to the housing and has an engagement portion which is concentrically positioned within the channel and formed to releasably engage the fastener. The fastener removal apparatus is further provided with a jack which is attached to the housing and has a force transmission member which is cooperatively engaged to the force transfer member and reciprocally movable along a lifting axis which extends in generally parallel relation to the housing axis. The actuation of the jack, subsequent to the engagement of the engagement portion to the fastener and positioning of the housing upon the structure, results in the movement of the force transmission member along the lifting axis in a direction away from the structure, thereby imparting a lifting force to the force transfer member which moves the engagement portion along the housing axis in a direction away from the structure, thus removing the fastener from therewithin.

25 Claims, 3 Drawing Sheets

PORTABLE FASTENER REMOVER APPARATUS

FIELD OF THE INVENTION

The present invention relates generally to fastener removal devices, and more particularly to a portable fastener removal apparatus which utilizes a hydraulic jack and a housing which is concentrically disposed about the fastener to be removed.

BACKGROUND OF THE INVENTION

Anchor bolts have found a wide range of uses in society. These fasteners are characterized by a shaft which defines an axis of radial symmetry which terminates at a tip. The shaft is formed to radially expand outward reaching a maximum diameter at the tip. A collar is slidably disposed around the shaft and has a diameter which is less than the diameter of the shaft at the tip. These anchor bolts are embedded in a hardened structure, such as concrete, and are specifically designed to resist removal once embedded. In this respect, the collar is formed to engage the surrounding structure and axially resists axial movement of the shaft once the expanded tip portion impinges upon the collar. Such anchor bolts have found common use for power racking or pallet racking in which the bolts are embedding in concrete flooring such as in warehouses. Typically the bolts used in such applications range from one-half to five-eighths of an inch in diameter and six to eleven inches in length. Anchor bolts are also commonly found in much larger sizes and may be used t5o attach base supports for street lamp posts, for example. The bolts may be formed of various metals, which include galvanized steel. The anchor bolts have exposed threaded ends which facilitate threaded engagement therewith. Such bolts are frequently required to be removed and/or eliminated when not utilized. Prior art methods of removal include cutting-off the exposed ends and grinding the shaft flush with the surrounding structure or floor. Alternately, the entire anchor element is removed utilizing a conventional core drilling method known in the prior art. Such prior art methods, however, are labor intensive and time consuming. Similarly, other embedded fasteners such as bolts, screws, nails, spikes and other elongate shaped members may be required to be removed and are subject to similar labor intensive and time-consuming methods of removal.

As such, there exists a need in the art of an apparatus for efficiently removing embedded fasteners, wherein the apparatus is relatively inexpensive to manufacture and easy to operate.

SUMMARY OF THE INVENTION

In accordance with the present invention, there is provided a portable fastener removal apparatus for removing an elongate fastener having an axis of radial symmetry from a structure in which the fastener is embedded. The fastener removal apparatus is provided with a housing having an elongate channel which defines a housing axis. The housing is sized and configured to be positionable upon the structure such that the housing axis is coaxially aligned with the axis of radial symmetry. The fastener removal apparatus is further provided with a force transfer member which is movably attached to the housing and has an engagement portion which is concentrically positioned within the channel and formed to releasably engage the fastener. The fastener removal apparatus is further provided with a jack which is attached to the housing and has a force transmission member which is cooperatively engaged to the force transfer member and reciprocally movable along a lifting axis which extends in generally parallel relation to the housing axis. The actuation of the jack, subsequent to the engagement of the engagement portion to the fastener and positioning of the housing upon the structure, results in the movement of the force transmission member along the lifting axis in a direction away from the structure, thereby imparting a lifting force to the force transfer member which moves the engagement portion along the housing axis in a direction away from the structure, thus removing the fastener from therewithin.

In the preferred embodiment of the present invention, the jack is a portable hydraulic jack. The force transfer member has a yoke which is attached to the fastener engagement portion and the yoke engages the force transmission member of the jack. The force transfer member further has an inner sleeve which is disposed between the engagement portion and the yoke. The channel of the housing concentrically receives the inner sleeve. The housing and the inner sleeve are formed of metal tubing which have rectangular cross-sections. The engagement portion takes the form of a notched plate disposed generally perpendicular to the lifting axis of the jack.

In addition, there is provided a method of using the above described fastener removal apparatus to remove embedded fasteners.

As such, based on the foregoing, the present invention mitigates the inefficiencies and limitations associated with prior art devices and methods of using the same to remove fasteners. Advantageously, the fastener removal apparatus of the present invention may utilize readily commercially available jacks. For example, the jack may take the form of a portable hand-operated bottle jack, such as those used with automobiles. In this regard, it is contemplated that the jack need not be specifically designed for use with the above described fastener removal apparatus and therefore is relatively inexpensive. It is further contemplated that the housing and the inner sleeve may be formed of sections of metal tubing. The yoke and the engagement portion of the force transfer member may be formed of sheet metal. The engagement portion preferably takes the form of a sheet metal plate which is notched. The notch receives the fastener to be removed. As such, the component parts of the above described fastener removal apparatus may be constructed from readily available materials which are relatively inexpensive. As one of ordinary skill in the art will appreciate, the manufacture of the apparatus from such materials is relatively simplistic, as conventional welding and cutting processes may be employed.

Furthermore, the present invention may avoid the use of complicated or cumbersome hydraulic lines, pneumatic or electrical lines, because the jack is preferably a portable jack. Thus, the fastener removal apparatus may be efficiently used to remove multiple fasteners in multiple locations without a complex deployment process of arranging and connecting attendant hydraulic lines, pneumatic or electrical lines as is found in prior art devices.

Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
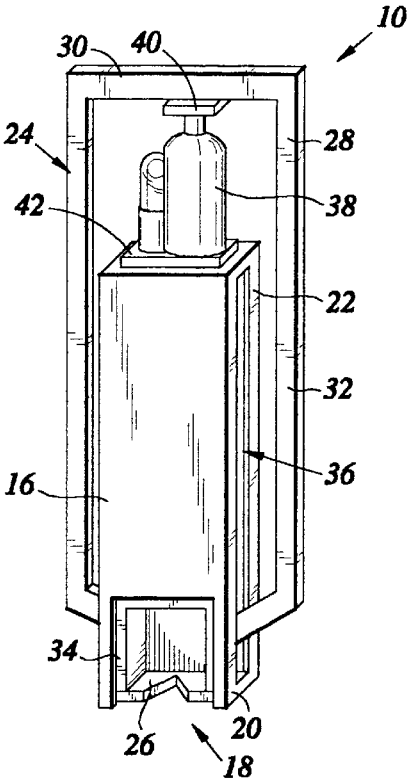
FIG. 1 depicts a perspective view of a portable fastener removal apparatus as constructed in accordance with the present invention.
Figure 2:
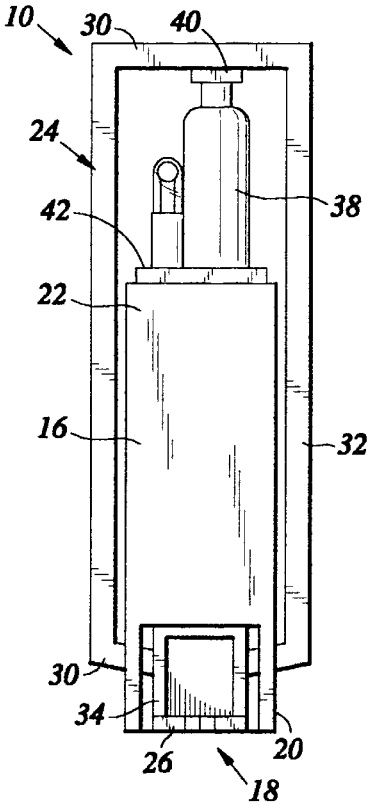
FIG. 2 depicts a front view of the fastener removal apparatus as seen in FIG. 1.
Figure 3:
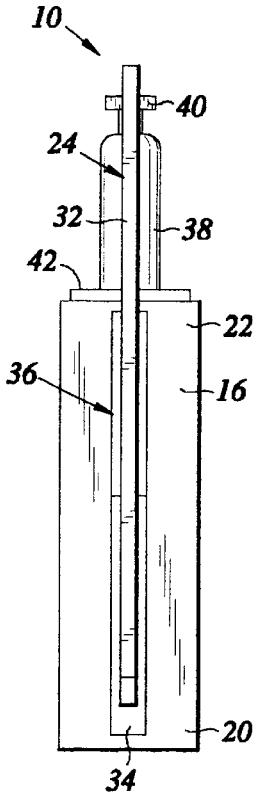
FIG. 3 depicts a side view of the fastener removal apparatus as seen in FIG. 1.
Figure 4:
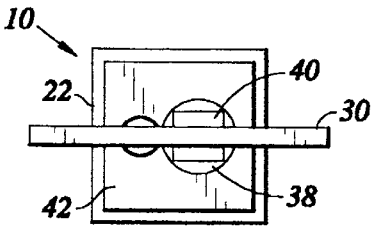
FIG. 4 depicts a top view of the fastener removal apparatus as seen in FIG. 1.
Figure 5:
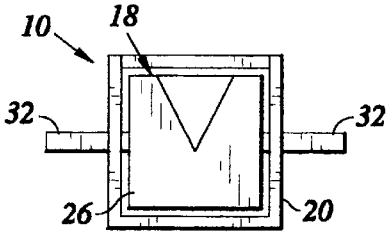
FIG. 5 depicts a bottom view of the fastener removal apparatus as seen in FIG. 1.
Figure 6:
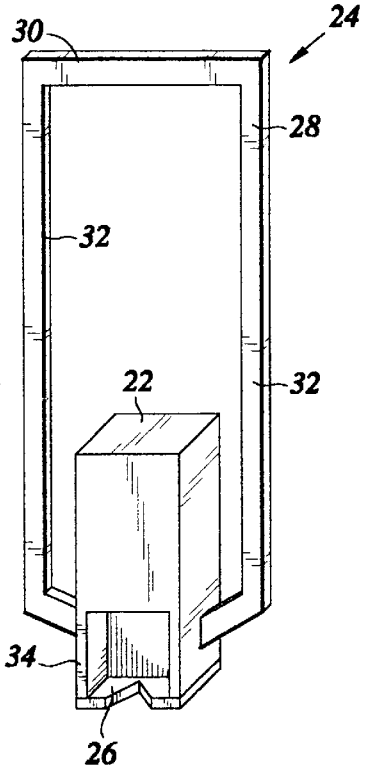
FIG. 6 depicts a perspective view of the force transfer member of the fastener removal apparatus shown in FIG. 1.
Figure 7:
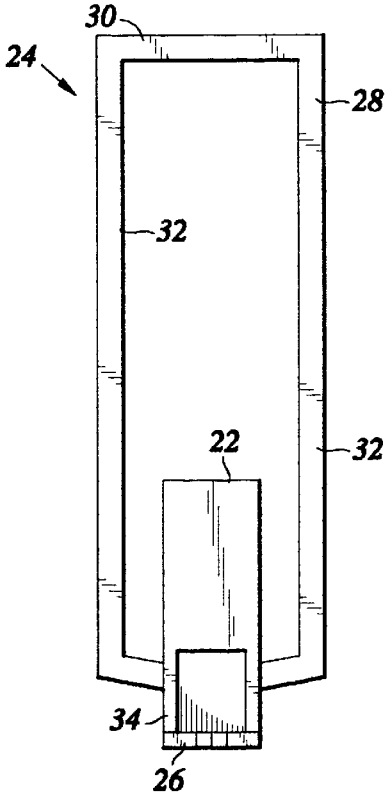
FIG. 7 depicts a front view of the force transfer member as seen in FIG. 6.
Figure 8:
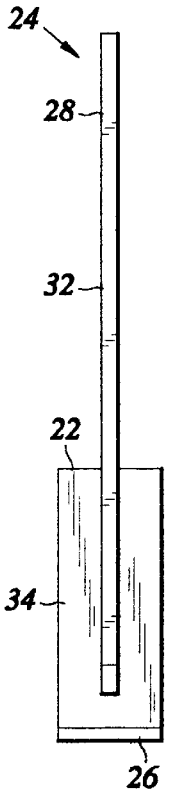
FIG. 8 depicts a side view of the force transfer member as seen in FIG. 6.
Figure 9:
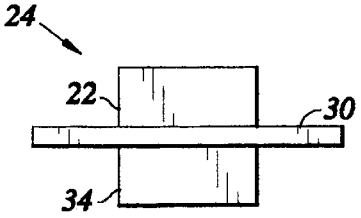
FIG. 9 depicts a top view of the force transfer member as seen in FIG. 6.
Figure 10:
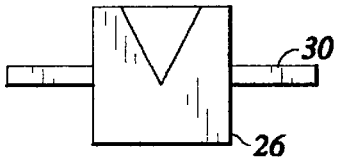
FIG. 10 depicts a bottom view of the force transfer member as seen in FIG. 6.

Referring now to the drawings wherein the showings are for purposes of illustrating a preferred embodiment of the present invention only, and not for purposes of limiting the same, FIGS. 1–13 illustrate a portable fastener removal apparatus which is constructed in accordance with the present invention.

In accordance with the present invention, there is provided a portable fastener removal apparatus 10 for removing an elongate fastener 12 having an axis of radial symmetry from a structure 14 in which the fastener 12 is embedded. It is contemplated that the fastener 12 to be removed is of a generally elongate shape and may be a bolt, an anchor bolt, a screw, a nail, a spike or other such member which may be removed using the below described fastener removal apparatus 10 of the present invention. For example, referring now to FIG. 11, a fastener 12 is shown in partial phantom. Depicted is a fastener 12 which is of an anchor bolt type. It is contemplated that the fastener 12 may be threaded and capable of receiving a nut 13. Where the fastener 12 is a nail or spike, although not shown, such a fastener 12 will typically be provided with a head which facilitates engagement of the fastener 12.

The fastener removal apparatus 10 is provided with a housing 16. The housing 16 has an elongate channel 18 which defines a housing axis. The housing 16 is sized and configured to be positionable upon the structure 14 such that the housing axis is coaxially aligned with the axis of radial symmetry of the fastener 12. In the preferred embodiment of the present invention, the housing 16 is generally elongate and formed of metal tubing which may have a rectangular, and preferably square, cross-section. Other shapes and configurations are contemplated which may be chosen from those well known to one of ordinary skill in the art, however, rectangular cross-sectional tubing is contemplated to be relatively readily available, inexpensive, easy to machine (e.g., cut, drill), easy to attach to other component parts (e.g., via welding) and structurally sound. The housing 16 has a base portion 20 and a top portion 22. The base portion 20 is formed to engage the structure 14 in which a fastener 12 is embedded. In this respect, the engagement surface of the base portion 20 is squared-off to be perpendicular to the axis of radial symmetry of the fastener 12. It is contemplated that the fastener 12 to be removed will typically be perpendicularly embedded in a structure 14. Thus, the squared-off or perpendicular nature of the base portion 20 in relation to the channel 18 is contemplated to facilitate support of the overall fastener removal apparatus 10 while the fastener 12 is engaged and to facilitate maintenance of alignment of the housing axis with the axis of radial symmetry of the fastener 12.

The fastener removal apparatus 10 is further provided with a force transfer member 24 as individually depicted in FIGS. 6–10. The force transfer member 24 is movably attached to the housing 16 and has an engagement portion 26 which is concentrically positioned within the channel 18 and formed to releasably engage the fastener 12. The force transfer member 24 preferably has a yoke 28. The yoke 28 may take the form of a cross bar 30 which connects a pair of legs 32. The force transfer member 24 further has an inner sleeve 34 which is disposed between the engagement portion 26 and the yoke 28. The channel 18 of the housing 16 concentrically receives the inner sleeve 34. Like the housing 16, the inner sleeve may advantageously be formed of metal tubing which may have a rectangular, and preferably square, cross-section. The cross section of the housing 16 is sized to be greater than the cross section of the inner sleeve 34 as to accommodate slidable engagement therebetween. The rectangular configuration of the housing 16 and the inner sleeve 34 is contemplated to prevent inner sleeve 34 from rotating relative to the housing 16 and thus limits the inner sleeve 34 solely to reciprocal movement along the channel of the housing 16. It is contemplated that the yoke 28 may be formed of sheet metal. As such, fabrication of the force transfer member 24 may utilize simple welding processes to attach the legs 32 of the yoke 28 to the inner sleeve 34.

Figure 11:
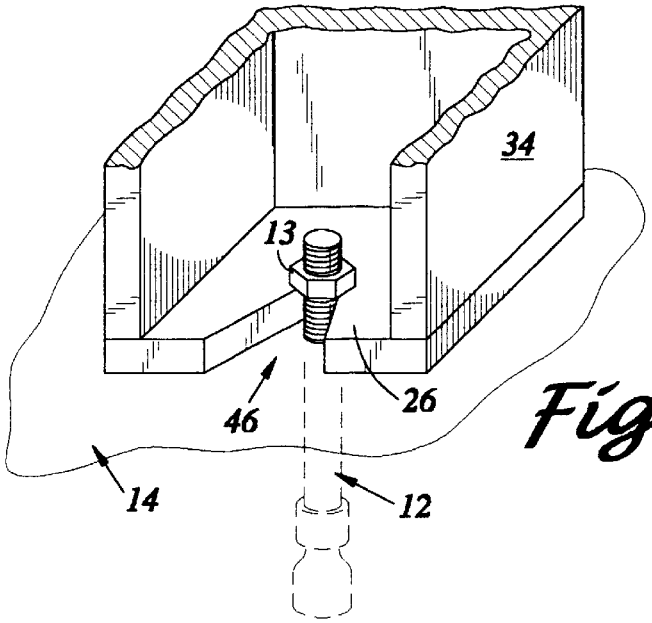
FIG. 11 depicts the engagement portion of the force transfer member engaged with an anchor bolt (shown in phantom.
Figure 13:
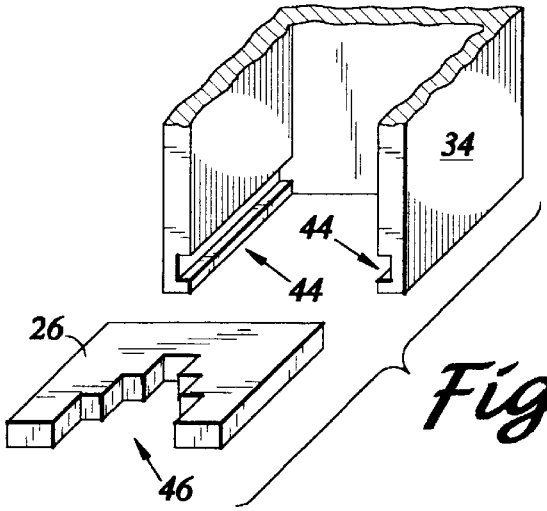
FIG. 13 depicts another alternative embodiment of the engagement portion of the force transfer member.

In the preferred embodiment of the present invention, the engagement portion 26 comprises a plate which is disposed generally perpendicular to the inner sleeve 34, as best depicted in FIG. 11. As can be seen, the engagement portion 26 may be attached to the inner sleeve 34. Preferably, the engagement portion 26 is formed of sheet metal. As such, as one of ordinary skill in the art will appreciate, where the inner sleeve 34 is formed of metal tubing and the engagement portion 26 is formed of sheet metal, a simple welding process may be employed and therefore facilitating ease of manufacture of the overall fastener removal apparatus 10. Alternatively, the engagement portion 26 may be removably attached to the inner sleeve 34 as depicted in FIG. 13. In this regard, the inner sleeve 34 may be provided with a pair of opposing grooves 44 which are formed to receive the engagement portion 26 in slidable contact for removal and attachment thereof. It is contemplated that the removability of the engagement portion 26 may facilitate a simple replacement process of the same as in the case where the part become damaged or worn or is required to be of a different size and configuration to facilitate engagement with various sized fasteners 12.

Figure 12:
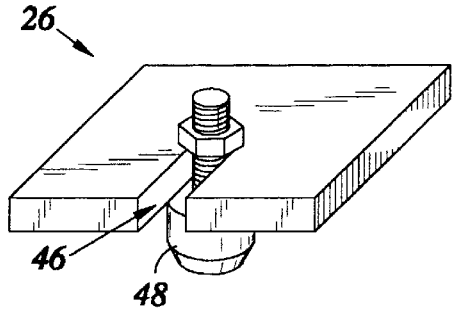
FIG. 12 depicts alternative embodiment of the engagement portion of the force transfer member.

The engagement portion 26, especially when of a plate type configuration, may be provided with a notch 46 which is formed to receive a fastener 12. The notch 46 may be of a variety of sizes and configurations which facilitate engagement of various sized fasteners 12. For example, the notch 46 may be U-shaped (as shown in FIG. 12). Alternatively, the notch 46 is may be V-shaped (as shown in FIG. 11) or graduated in a stepwise manner for receiving fasteners 12 having different size cross sections as accommodated by the varying width of the notch 46. The engagement portion 12 may further be provided with a adjustable chuck 48 for laterally engaging a fastener 12 as shown in FIG. 12. The chuck 48 may be directly attached to the inner sleeve 34 or conveniently attached at the notch 46. It is contemplated that the chuck 48 may be used where the fastener 12 does not have a nut 13 or is capable of having a nut 13 threaded thereon or a head. The chuck 48 may be of the type which is commonly used which portably drills for attaching drill bits thereto. The chuck 48 radially engages fasteners 12. It is contemplated that other members may be used instead of a chuck 48 which may engage a fastener, radially or otherwise, and may be chosen from those which are well known to one of ordinary skill in the art. For example, such members may utilize hooks, claws, toothed jaws, grapples, and etc. which are designed to engage a fastener 12.

The fastener removal apparatus 10 is further provided with a jack 38 which is attached to the housing 16. In this regard, the jack 38 is provided with a base 42 which is attached to the top portion 22 of the housing 16. The jack 38 has a force transmission member 40 which is cooperatively engaged with the force transfer member 24. In particular, the force transmission member 40 contacts the cross bar 30 of the yoke 28. The force transmission member 40 is reciprocally movable along a lifting axis which extends in generally parallel relation to the housing axis. Preferably, the jack 38 is a portable self-contained device. As such, the jack 38 is hand-operated. As shown in FIGS. 1–4, the jack 38 may be a hydraulic jack, wherein the force transmission member 40 is a piston. Such hydraulic jacks are readily commercially available and have various lifting force capacities which may range from one to twenty tons of lifting force per square inch. Alternatively, the jack 38 may be a bottle jack, a screw jack, a rack and lever jack or others which are well known to one of ordinary skill in the art. It is contemplated that the jack 38 may be actuated via a handle which is mechanically pumped by the operator. Typically, the jack 38 is provided with a base 42. As such, the base 42 may be removably attached to the top portion 22 of the housing 16. Such attachment is contemplated to facilitate easy replacement of the jack 38 for upgraded lifting capacity or when the jack is damaged.

In operation, the actuation of the jack 38, subsequent to the engagement of the engagement portion 26 to the fastener 12 and positioning of the housing 16 upon the structure 14, results in the movement of the force transmission member 40 along the lifting axis in a direction away from the structure 14. As such a lifting force is imparted to the force transfer member 24 which moves the engagement portion 26 along the housing axis in a direction away from the structure 14, thus removing the fastener 12 from therewithin. Thus, a lifting force is imparted to the engaged fastener 12 while an opposing force is imparted to the surrounding structure 14 via the base portion 20 of the housing 16. It is contemplated that the concentric nature of the housing 16 and channel 18 therein facilitates a distributed localized opposing force on the structure 14 about the fastener 12. In the regard, a concentrated shearing action is initiated upon actuation of the jack 38 which facilitates efficient removal of the fastener 12 from the structure 14.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A portable fastener removal apparatus for removing an elongate fastener having an axis of radial symmetry from a structure in which the fastener is embedded, the fastener removal apparatus comprising:

a housing having an elongate channel which defines a housing axis, the housing further having a self-supporting base surface defining a plane generally perpendicular to the housing axis for contacting the structure and supporting the fastener removal apparatus against thereto, the self-supporting base surface being generally C-shaped, the housing being sized and configured to be positionable upon the structure such that the housing axis is coaxially aligned with the axis of radial symmetry;

a force transfer member movably attached to the housing and having an engagement portion which is concentrically positioned within the channel and formed to releasably engage the fastener; and a jack attached to the housing and having a force transmission member which is cooperatively engaged to the force transfer member and reciprocally movable along a lifting axis which extends in generally parallel relation to the housing axis;

wherein the actuation of the jack subsequent to the engagement of the engagement portion to the fastener and positioning of the housing upon the structure results in the movement of the force transmission member along the lifting axis in a direction away from the structure thereby imparting a lifting force to the force transfer member which moves the engagement portion along the housing axis in a direction away from the structure thus removing the fastener from therewithin.

2. The fastener removal apparatus of claim 1 wherein the jack comprises a hydraulic jack and the force transmission member comprises a piston.

3. The fastener removal apparatus of claim 2 wherein the jack is portable.

4. The fastener removal apparatus of claim 1 wherein the force transfer member has a yoke attached to the fastener engagement portion, the yoke being formed to engage the force transmission member of the jack.

5. The fastener removal apparatus of claim 4 wherein the yoke being formed of sheet metal.

6. The fastener removal apparatus of claim 4 wherein the yoke having a cross bar being formed to engage the force transmission member of the jack, and a pair of elongate legs disposed between the cross bar and the engagement portion.

7. The fastener removal apparatus of claim 6 wherein the housing has a pair of elongate slots formed to receive respective ones of the elongate legs of the force transfer member.

8. The fastener removal apparatus of claim 4 wherein the force transfer member has an inner sleeve disposed between the engagement portion and the yoke, the channel of the housing being sized and configured to concentrically receive the inner sleeve.

9. The fastener removal apparatus of claim 8 wherein the housing and the inner sleeve being formed of tubing.

10. The fastener removal apparatus of claim 8 wherein the housing and the inner sleeve have rectangular cross-sections, the cross-section of the housing being greater than the cross-section of the inner sleeve.

11. The fastener removal apparatus of claim 8 wherein the engagement portion comprises a plate disposed generally perpendicular to the lifting axis of the jack.

12. The fastener removal apparatus of claim 11 wherein the inner sleeve being formed to laterally receive the plate in slidable contact for removal and attachment thereof.

13. The fastener removal apparatus of claim 1 wherein the engagement portion comprises a plate disposed generally perpendicular to the lifting axis of the jack.

14. The fastener removal apparatus of claim 13 wherein the plate has a notch formed therein for laterally receiving the fastener thereat.

15. The fastener removal apparatus of claim 14 wherein the notch is V-shaped.

16. The fastener removal apparatus of claim 14 wherein the notch is graduated in a stepwise manner for receiving fasteners having different size cross sections.

17. The fastener removal apparatus of claim 14 wherein the plate is formed of sheet metal.

18. The fastener removal apparatus of claim 1 wherein the engagement portion comprises an adjustable chuck for laterally engaging the elongate fastener.

19. A portable fastener removal apparatus for removing an elongate fastener having an axis of radial symmetry from a structure in which the fastener is embedded, the fastener removal apparatus comprising:

a housing having an elongate channel which defines a housing axis, the housing being sized and configured to be positionable upon the structure such that the housing axis is coaxially aligned with the axis of radial symmetry, the housing having a pair of elongate slots;

a force transfer member having an engagement portion, a pair of elongate legs, and a cross bar disposed between the elongate legs, the elongate legs being disposed between the cross bar and the engagement portion, the elongate legs extending through respective ones of the elongate slots of the housing, the engagement portion being concentrically positioned within the channel and formed to releasably engage the fastener; and a jack attached to the housing and having a force transmission member which is cooperatively engaged to the cross bar and reciprocally movable along a lifting axis which extends in generally parallel relation to the housing axis;

wherein the actuation of the jack subsequent to the engagement of the engagement portion to the fastener and positioning of the housing upon the structure results in the movement of the force transmission member along the lifting axis in a direction away from the structure thereby imparting a lifting force to the force transfer member which moves the engagement portion along the housing axis in a direction away from the structure thus removing the fastener from therewithin.

20. A portable fastener removal apparatus for removing an elongate fastener having an axis of radial symmetry from a structure in which the fastener is embedded, the fastener removal apparatus comprising:

a housing having an elongate channel which defines a housing axis, the housing being sized and configured to be positionable upon the structure such that the housing axis is coaxially aligned with the axis of radial symmetry;

a force transfer member movably attached to the housing, the force transfer member having an engagement portion, a yoke attached to the engagement portion, and an inner sleeve, the inner sleeve being disposed between the engagement portion and the yoke, inner sleeve being sized and configured to be concentrically received by the channel, the engagement portion being concentrically positioned within the channel and formed to releasably engage the fastener; and a jack attached to the housing and having a force transmission member which is cooperatively engaged to the yoke and reciprocally movable along a lifting axis which extends in generally parallel relation to the housing axis;

wherein the actuation of the jack subsequent to the engagement of the engagement portion to the fastener and positioning of the housing upon the structure results in the movement of the force transmission member along the lifting axis in a direction away from the structure thereby imparting a lifting force to the force transfer member which moves the engagement portion along the housing axis in a direction away from the structure thus removing the fastener from therewithin.

21. The fastener removal apparatus of claim 20 wherein the housing and the inner sleeve being formed of tubing.

22. The fastener removal apparatus of claim 20 wherein the housing and the inner sleeve have rectangular cross-sections, the cross-section of the housing being greater than the cross-section of the inner sleeve.

23. The fastener removal apparatus of claim 20 wherein the engagement portion comprises a plate disposed generally perpendicular to the lifting axis of the jack.

24. The fastener removal apparatus of claim 23 wherein the inner sleeve being formed to laterally receive the plate in slidable contact for removal and attachment thereof.

25. A portable fastener removal apparatus for removing an elongate fastener having an axis of radial symmetry from a structure in which the fastener is embedded, the fastener removal apparatus comprising:

a housing having an elongate channel which defines a housing axis, the housing being sized and configured to be positionable upon the structure such that the housing axis is coaxially aligned with the axis of radial symmetry;

a force transfer member movably attached to the housing and having an engagement portion which is concentrically positioned within the channel and formed to releasably engage the fastener, the engagement portion comprising a plate disposed generally perpendicular to the lifting axis of the jack, the plate having a notch formed therein for laterally receiving the fastener thereat, the notch being graduated in a stepwise manner for receiving fasteners having different size cross sections; and a jack attached to the housing and having a force transmission member which is cooperatively engaged to the force transfer member and reciprocally movable along a lifting axis which extends in generally parallel relation to the housing axis;

wherein the actuation of the jack subsequent to the engagement of the engagement portion to the fastener and positioning of the housing upon the structure results in the movement of the force transmission member along the lifting axis in a direction away from the structure thereby imparting a lifting force to the force transfer member which moves the engagement portion along the housing axis in a direction away from the structure thus removing the fastener from therewithin.

* * * * *